US007153225B2

(12) United States Patent
Morrow

(10) Patent No.: US 7,153,225 B2
(45) Date of Patent: Dec. 26, 2006

(54) AMBIDEXTROUS PITCHING SCREEN SYSTEM

(75) Inventor: William David Morrow, Fort Collins, CO (US)

(73) Assignee: Morrow Sports, LLC, Fort Collins, CO (US)

( * ) Notice: Subject to any disclaimer, the term of this patent is extended or adjusted under 35 U.S.C. 154(b) by 0 days.

(21) Appl. No.: 10/958,536

(22) Filed: Oct. 4, 2004

(65) Prior Publication Data

US 2006/0073919 A1 Apr. 6, 2006

(51) Int. Cl.
*A63B 69/00* (2006.01)

(52) U.S. Cl. ..... 473/454; 273/400; 473/197; 473/451

(58) Field of Classification Search ..... 473/422, 473/454–456, 446, 434, 476, 478, 197; 273/401, 273/402, 410, 407
See application file for complete search history.

(56) References Cited

U.S. PATENT DOCUMENTS

| | | | | |
|---|---|---|---|---|
| 3,195,898 | A * | 7/1965 | Respini | 473/197 |
| 5,088,740 | A * | 2/1992 | Peterson | 273/410 |
| 5,342,063 | A * | 8/1994 | O'Brien et al. | 273/396 |
| 5,690,339 | A * | 11/1997 | Chen | 273/400 |
| 6,210,288 | B1 * | 4/2001 | Kim | 473/197 |
| 6,247,699 | B1 * | 6/2001 | Macaluso | 273/400 |
| 6,543,776 | B1 * | 4/2003 | Macaluso | 273/400 |
| 6,672,980 | B1 * | 1/2004 | Walsh | 473/478 |
| 6,878,078 | B1 * | 4/2005 | Swanson | 473/454 |
| 6,893,364 | B1 * | 5/2005 | Grunfeld | 473/446 |
| 6,928,951 | B1 * | 8/2005 | Huang | 116/63 P |
| 6,955,615 | B1 * | 10/2005 | Cavell | 473/451 |
| 2003/0236140 | A1 * | 12/2003 | Alford | 473/454 |

OTHER PUBLICATIONS

2002 TOMARK Sports Catalog, pp. 47 protective screens, 48 practice screens and 53 batting aids; www.tomark.com.*
BASSCO, Pitching Screen, http://www.bassco.com/product info.php/products, downloaded Sep. 23, 2004, 1 page.
ONLINE SPORTS.COM, Pitcher's Protective "L " Screen, http//www.onlinesports.com, downloaded Sep. 23, 2004, 2 pages.
BASEBALL TIPS.COM, Pro L-Screen, http://www.baseballtips.com, downloaded Sep. 23, 2004, 1 page.
CAGES-PLUS, Portable Batting Cages With L-Screen, http:www.cagesplus.com, downloaded Sep. 23, 2004, 8 pages.
FOGDOG SPORTS, ATEC Pitcher's L Screen, http://www.fodog.com/, downloaded Sep. 23, 2004, 2 pages.

* cited by examiner

*Primary Examiner*—Mitra Aryanpour
(74) *Attorney, Agent, or Firm*—Craig R. Miles; CR Miles, P.C.

(57) ABSTRACT

A pitching screen which provides a first pitching lane and a second pitching lane in a single pitching screen configuration to allow both left-handed pitchers and right-handed pitchers to pitch without repositioning the pitching screen.

10 Claims, 5 Drawing Sheets

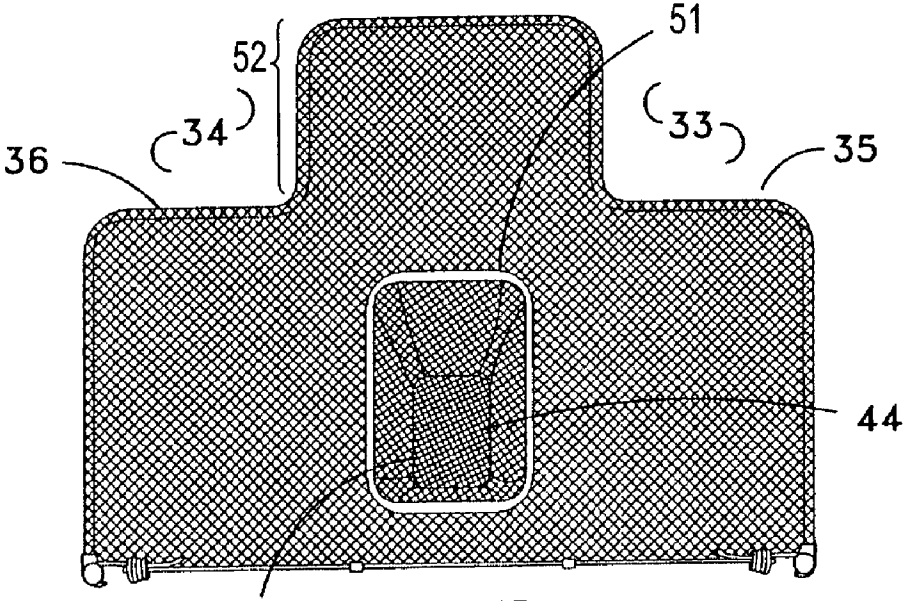
Fig. 4B
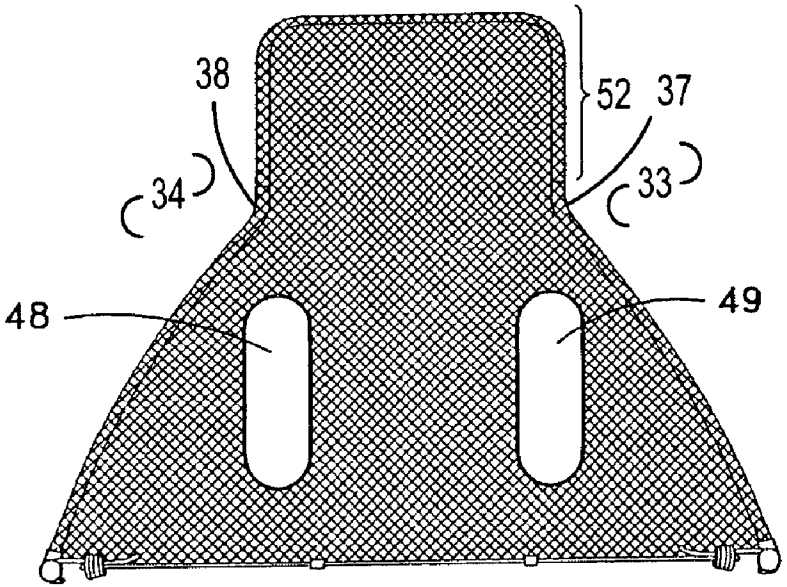
Fig. 4A
Fig. 4

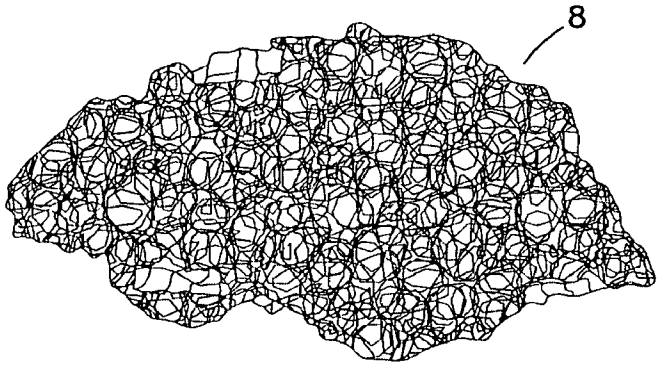
Fig. 5C
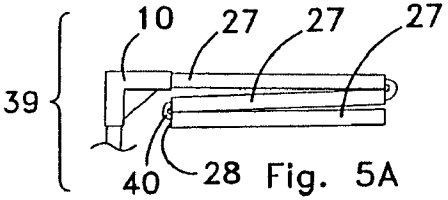
Fig. 5A
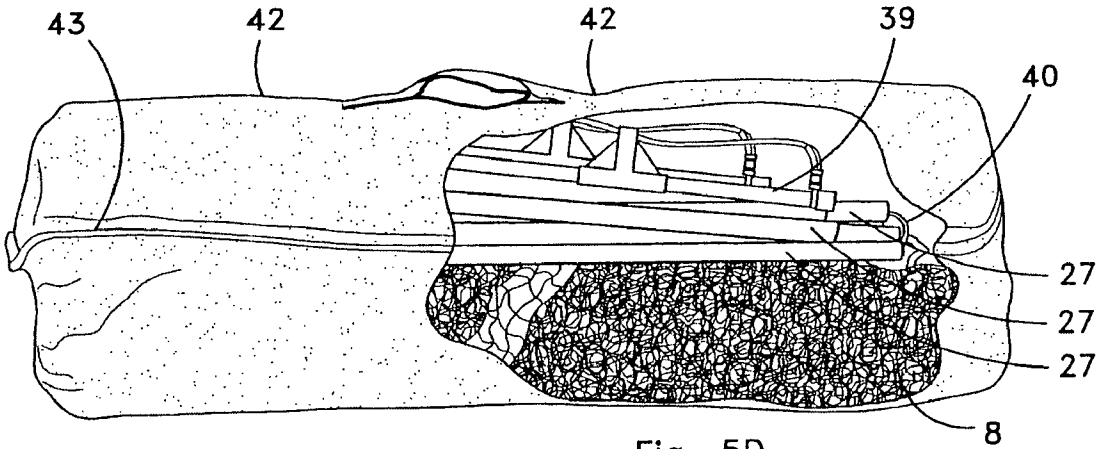
Fig. 5D
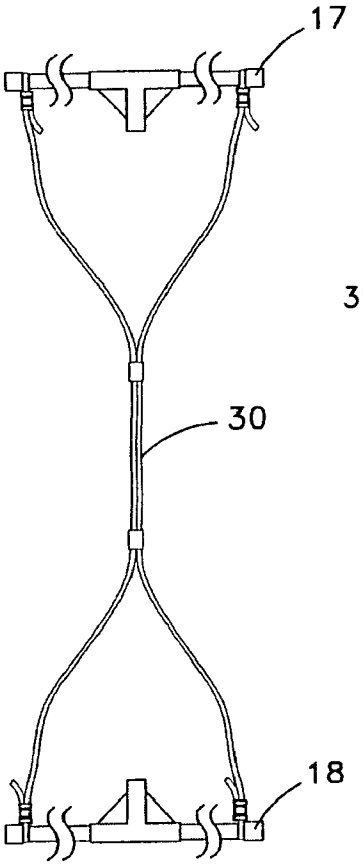
Fig. 5B
Fig. 5

AMBIDEXTROUS PITCHING SCREEN SYSTEM

I. BACKGROUND

An ambidextrous pitching screen which provides in a single configuration a first pitching lane and a second pitching lane allowing both left-handed pitchers and right-handed pitchers to serially pitch from behind the same pitching screen without repositioning the pitching screen to accommodate the pitchers' handedness.

Conventional pitching screens have an L-shaped configuration which supports a net to deflect batted balls. The L-shaped configuration of conventional pitching screens provides a single pitching lane in a square or rectangular cutout on one side of an otherwise square pitching screen. The L-shaped configuration of pitching screen is first positioned with the square cutout on the right side for right handed pitchers and is then repositioned to locate the square cutout on the left hand side for left hand pitchers.

Even though there is large commercial market for pitching screens and numerous manufacturers have met the demand of that commercial market with a variety of conventional L-shaped configuration pitching screens, there are still a number of problems unresolved by conventional L-shaped configuration pitching screen technology.

A significant problem with conventional L-shaped configuration pitching screen technology can be that it does not accommodate both left-handed pitchers and right-handed pitchers without being repositioned to accommodate the handedness of the pitcher. An L-shaped screen must first be positioned to accommodate a left handed pitcher and then positioned a second time to accommodate a right handed pitcher. Repositioning the L-shaped screen between pitchers can be distracting to the pitcher or the batter and reduces the time for pitching or batting practice.

Another significant problem with conventional L-shaped configuration pitching screen technology can be that the square or rectangular cutout does not entirely protect the pitcher after the release of the pitch. After release of the pitch, the profile of the pitcher's body places the pitching shoulder and upper back in the area of the cutout as shown by FIG. 1A. Batted balls having a trajectory through the cutout can hit the pitcher in the pitching shoulder or upper back. Certain manufacturers have attempted to address this problem by configuring the net supported by conventional L-shaped pitching screens to extend into a portion of the square cutout.

Another significant problem with conventional pitching screen technology can be that the support frame may not break down into smaller components. Pitching screens can typically be seven feet high by seven feet wide with a cutout of three and one-half feet by three and one-half feet. As such, pitching screens that do not break down can be difficult to store and transport.

Another significant problem with conventional pitching screen technology can be that disassembly yields numerous separate loose components. These loose components can be easily misplaced or can take additional time to locate for reassembly.

Yet another significant problem with conventional pitching screen technology can be that assembled discrete components do not afford any manner of securement against disengagement during use. As such, conventional couplings between components can for example disengage during use as the pitching screen is turned to accommodate a different handed pitcher, inadvertently struck by the pitcher during use, or when hit by batted balls.

The instant invention addresses each of these problems with conventional pitching screen technology.

II. SUMMARY OF THE INVENTION

Accordingly, a broad object of the invention can be to provide a pitching screen having support structure which allows both left-handed pitchers and right-handed pitchers to serially pitch from behind the same pitching screen without first accommodating the pitcher's handedness by repositioning the pitching screen.

A second broad object of the invention can be to provide a pitching screen having a support structure configured to protect the pitcher in the position that results after normal follow through from a pitch. As shown by FIG. 1A, the portion of the pitcher's body after throwing a pitch has an arcuate profile which may not be protected by a conventional L-shaped pitching screens.

A third broad object of the invention can be to provide a pitching screen which assembles from linear segments readily portable in a single container by a single person on foot.

A fourth broad object of the invention can be to provide a pitching screen assembled from segments having elastically tensioned couplings which resist disassembly during use of the pitching screen.

Naturally, further objects of the invention are disclosed throughout other areas of the specification, drawings, photographs, and claims.

III. A BRIEF DESCRIPTION OF THE DRAWINGS

FIG. 3F provides and enlargement of an embodiment of an elastically tensioned coupling between linear support segments.

FIG. 3G shows an embodiment of a tee coupler to which a pair of tee extensions are joined to generate a base which maintains the support structure in a substantially fixed orientation to a support surface.

FIG. 3H shows an embodiment of a resiliently flexible restraining element.

FIG. 4A shows an alternate embodiment of the pitching screen invention.

FIG. 4B shows an alternate embodiment of the pitching screen invention.

FIG. 5 shows an embodiment of the pitching screen invention disassembled into the components shown by FIGS. 5A, 5B, and 5C stored in a single container.

FIG. 5A shows the linear support structure of an embodiment of the pitching screen invention disassembled into linear segments.

FIG. 5B shows an embodiment of the base having a pair of tees disassembled into a pair of tee couplers each having a pair of tee extensions.

FIG. 5C shows an embodiment of the net folded for storage.

FIG. 5D shows and embodiment of a container in which the disassembled components of an embodiment of the pitching screen invention can be stored.

IV. DETAILED DESCRIPTION OF THE PREFERRED EMBODIMENTS

Figure 1:
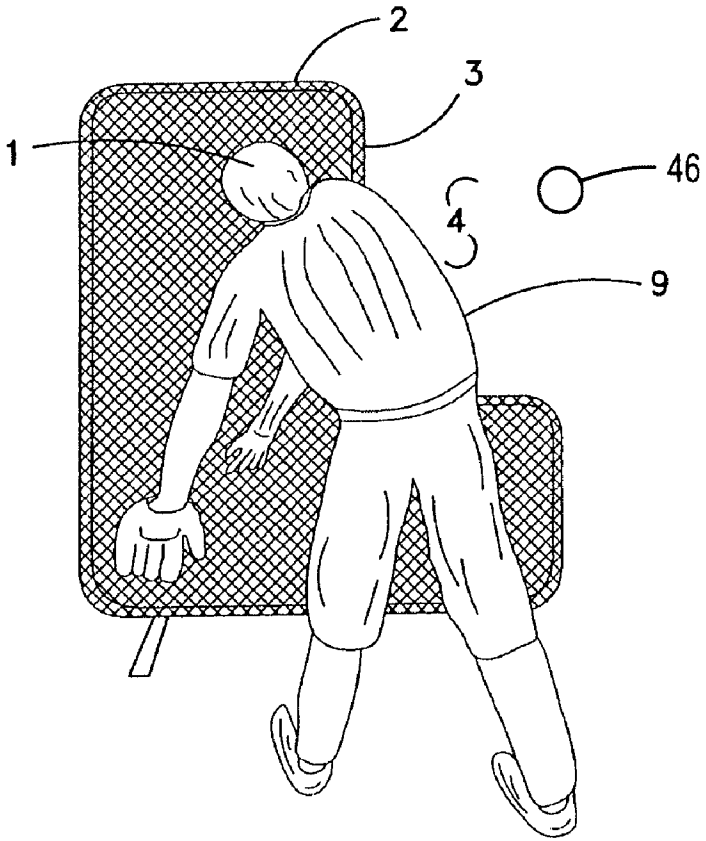
CONVENTIONAL ART Fig. 1
FIG. 1 shows a conventional L-screen with the body of a pitcher in a position which occurs after a pitch.

Now referring primarily to FIG. 1, a profile of pitcher (1) positioned after a pitch of an object (46), such as a baseball, shows that a conventional L-shaped pitching screen (2)(a substantially square screen having a cutout (3) of substantially square or rectangular configuration which provides an a single pitching lane (4)) may not protect a portion of the pitcher (1) from batted balls (not shown). Batted balls that pass through a substantially square or rectangular cutout (3) can result in injury to the pitcher (1) which may be especially harmful because injury can occur on the throwing arm side of the pitcher's (1) body.

Figure 2:
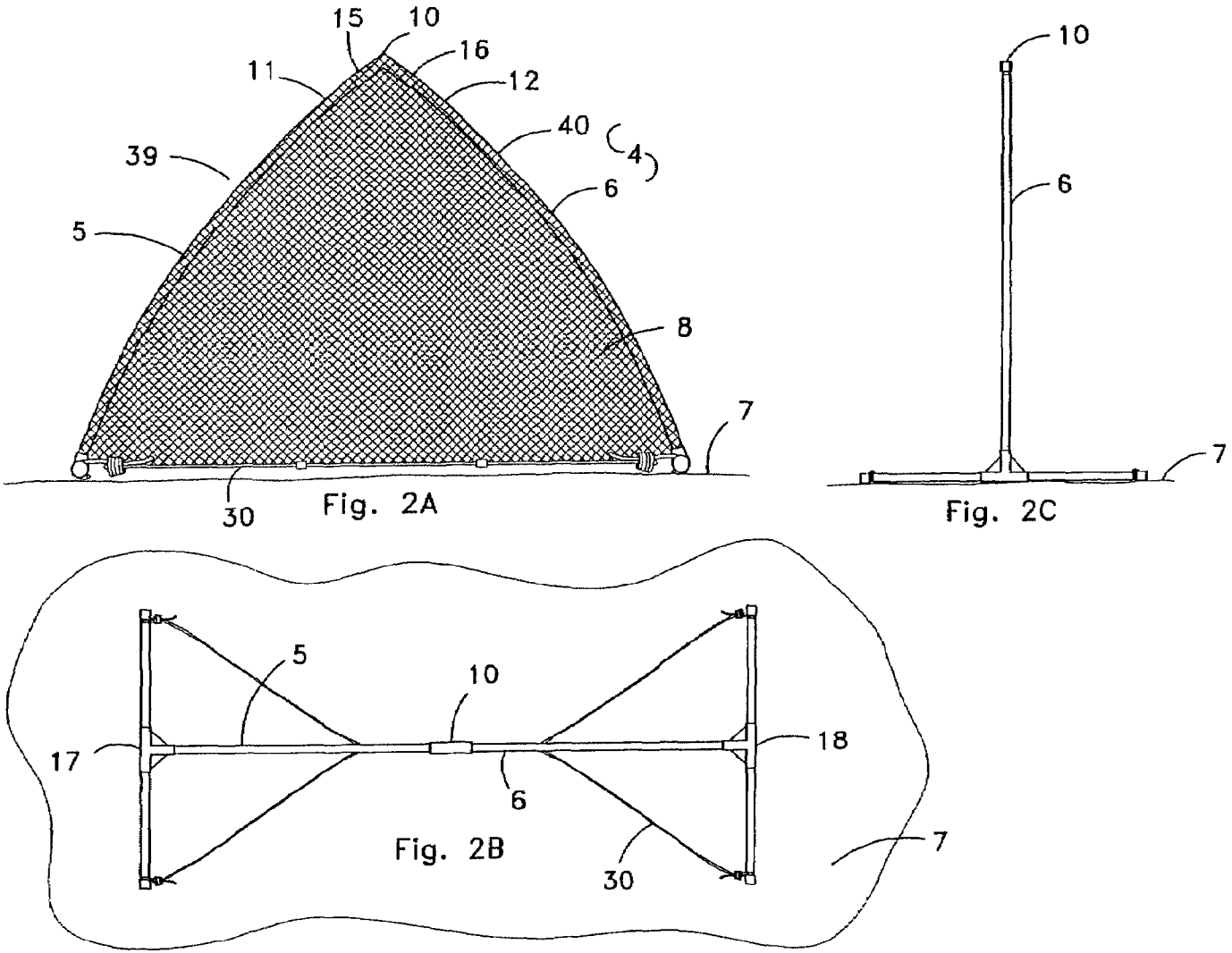
FIG. 2A shows a front view of an embodiment of the pitching screen invention having an arcuate support elements.
FIG. 2B shows a top view of an embodiment of the pitching screen invention having arcuate support elements.
FIG. 2C shows an end view of an embodiment of the pitching screen invention having arcuate support elements.

Now referring primarily to FIGS. 2A, 2B, and 2C which provide a front view, top view and side view of a non-limiting example of a pitching screen in accordance with the invention, a first arcuate support element (5) and a second arcuate support element (6) can be positioned a distance apart in substantially bilateral symmetry about an axis which extends vertically from a support surface (7). The first arcuate support element (5) and the second arcuate support element (6) provide a support structure to which an object deflection material (8) can substantially conform.

Now referring primarily to FIGS. 1 and FIG. 2A, it can be understood that the profile of the pitcher (1) positioned after a pitch (as shown by FIG. 1) includes an arcuate profile (9) the curvature of which can be protected from batted balls by the configuration of the first arcuate support element (5) or the second arcuate support element (6) depending on the handedness of the pitch. The example of the arcuate support elements(5)(6) shown by FIG. 2A is not intended to be limiting with respect to the numerous and wide variety of configurations which the arcuate supports (5)(6) or pitching screens including an arcuate support element can take to protect the arcuate profile (9) of the pitcher (1) and still allow the pitcher at least one pitching lane (4) in which the trajectory of the ball can pass. Preferred embodiments of the pitching screen invention similar to that shown in FIG. 2A may provide at least one arcuate support element (5) or (6) which defines a portion of a circle of greater or lesser radius of between about 36 inches and about 120 inches. A specific example of the pitching screen invention as shown in FIG. 2A provides a radius of between about 36 inches and about 72 inches.

As to other embodiments of the inventive pitching screen, the arcuate support elements may be configured to be similar, match, or correspond to the arcuate profile (9) of the pitcher (1) positioned after follow through from a pitch. Depending on the stature of the pitcher (1) the configuration of the arcuate supports (5)(6) may vary to allow a greater portion of the arcuate profile (9) of the pitcher (1) to be protected from batted balls after the pitch than is afforded by conventional pitching screen technology. As such, the term arcuate support or arcuate support element is not meant to be limiting but rather to expansively encompass the numerous and varied support structures configured with at least one support element having curvature that can protect the arcuate profile (9) of the pitcher to a greater degree than conventional pitching screen technology.

The arcuate support elements (5)(6) can be produced from a variety of materials including, but not limited to, plastic, such as polyvinylchloride, virgin polyvinylchloride, acrylonitrile butadiene styrene, or the like; expanded crosslinked polymers; various types of metals such as aluminum; and composite materials such as fiberglass, carbon fiber, or the like, or various permutation and combinations of each. The configuration of the arcuate supports in cross section can be any desired geometry, such as, circular, oval, rectangular, square, triangular, trapezoidal, L-shaped, or the like. A preferred embodiment of the arcuate support elements (5)(6) as shown in FIG. 2A can be produced from tubular polyvinyl chloride having a circular cross section, but this is not intended to be limiting with respect to other embodiments of the inventive pitching screen in which the arcuate support elements (5)(6) can be produced from solid, semisolid, cellular, hollow, or other materials that can be configured in an arcuate configuration in accordance with the invention.

Again referring primarily to FIG. 2A, the object deflection material (8) can be a net having apertures sufficiently small to deflect a batted object (46), such as a ball. The net can be generated from a variety of materials such as nylon, polyethylene, polypropylene, polyester, acrylic, metal strands, cotton fiber, GORE-TEX®, or the like, separately or in various combinations or permutations. The net made from these various materials, and others, can also be coated with a layer of a second material, such as: vinyl, latex, or rubber. The net can have apertures from about 0.25 millimeter to about 50 millimeters depending on the pitching application. The apertures can be of various geometry, such as: square, rectangular, hexagonal, diamond, or the like. With respect to a preferred embodiment of the inventive pitching screen, the net can provide square apertures of about two inches by about two inches. Alternately, the object deflection material could be a mesh or a web; plastic sheeting; a woven sheeting, or the like.

Now again referring primarily to FIG. 2A and FIG. 3A, certain embodiments of the inventive pitching screen can further include a coupler (10) to which said first arcuate support (5) and said second arcuate support element (6) are coupled. The coupler (10) can be configured to allow slidable insertion of a first end (11) of the first arcuate support element (5) and a first end (12) of the second arcuate support element (6) into corresponding one each of a first coupler receptacle (13) and a second coupler receptacle (14). While the coupler (10) as shown in FIG. 2A has a first coupler leg (15) and a second coupler leg (16) disposed at about a ninety degree angle, embodiments of the inventive pitching screen can provide the coupler (10) in a variety of configurations. For example, the first coupler leg (15) and the second coupler leg (16) can be disposed at an angle of between about eighty degrees and about one hundred degrees. Alternately, the legs (15)(16) of the coupler (10) could independently rotate about the axis of a shaft to provide a variably adjustable angle between the first arcuate support (5) and the second arcuate support (6). Other embodiments of the inventive pitching screen, can provide a coupler (10) having a rectangular configuration to extend the screen vertically as shown for example in FIG. 4A.

Naturally, embodiments of the inventive pitching screen can include a coupler (10) of any desired shape which allows the arcuate support elements (5)(6) to be disposed in a manner which protects the arcuate profile (9) of a pitcher to a greater extent than the conventional technology.

Now referring primarily to FIGS. 2B and 2C, the inventive pitching screen can further include a base which maintains the support structure in substantially fixed orientation to a support surface (7). As shown by FIG. 2B, the base, as to certain embodiments of the the inventive pitching screen, can comprise a first tee element (17) and a second tee element (18). The first tee element (17) and the second tee element (18) can each be a single integral piece with legs extending a sufficient length to maintain orientation of the first arcuate support element (5) and the second arcuate support element (6) to the support surface (7) as desired. Other embodiments of the inventive pitching screen can provide tee elements (19)(20) which have a pair of removable legs (21)(22) and (23)(24)(See FIG. 3A). The tee elements as above-described are not intended to be limiting with respect to the numerous and varied configurations of bases which can be utilized to establish the support structure in a particular orientation with respect to the support surface (7). The base could alternately be configured as round, square, or oval pedestals; or include additional legs; stakes (with or without guy wires); or any base configuration which can be utilized to orient the support structure of the pitching screen to the support surface (7) in accordance with invention (naturally some flexure or movement of the support structure will occur depending on the material from which the pitching screen is configured and the manner of joining any segments or components of the support structure).

Figure 3:
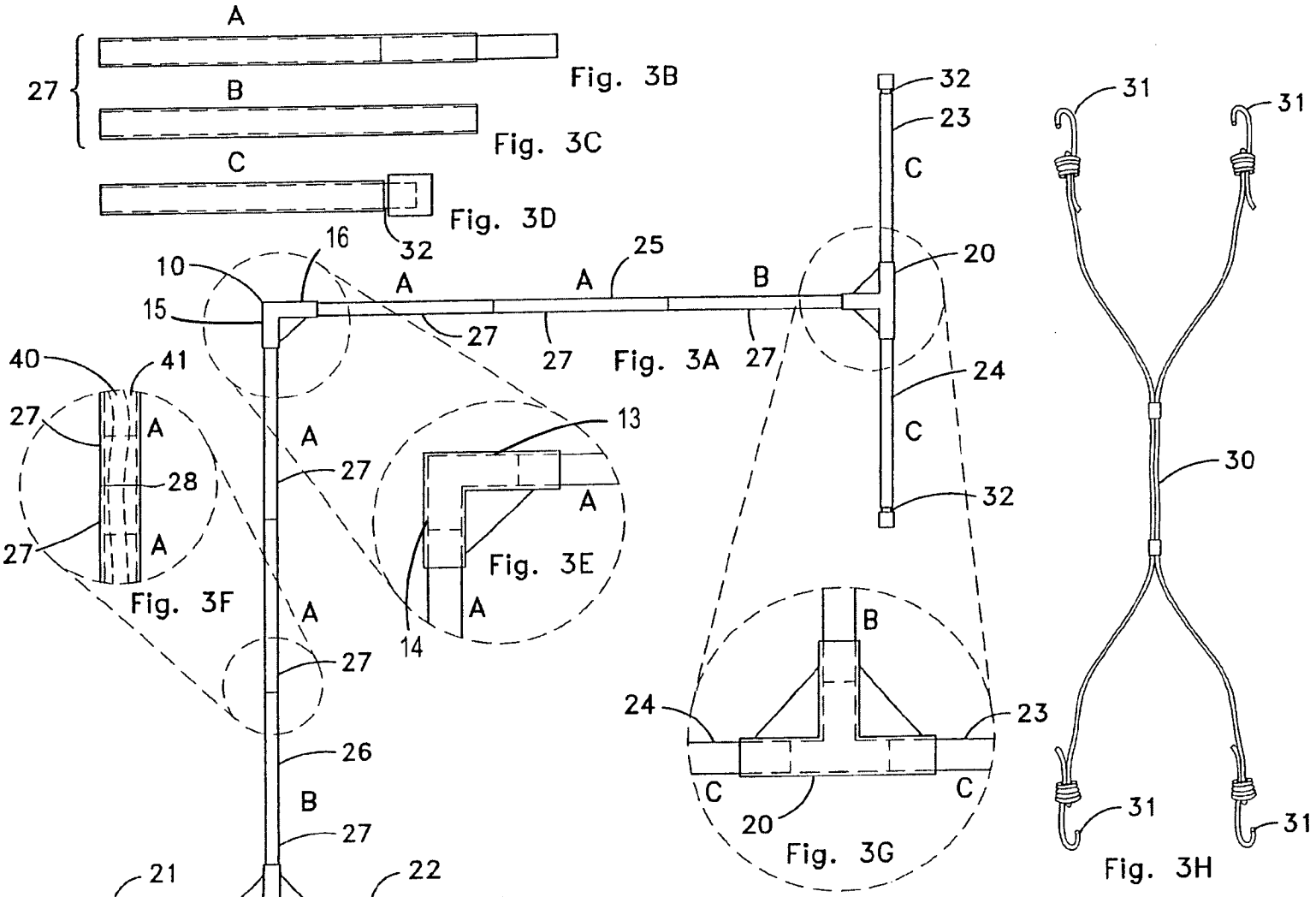
FIG. 3A shows an embodiment of the pitching screen invention having linear support structure generated by coupling a plurality of axially coupled linear support elements.
FIG. 3B shows an embodiment of a linear support segments.
FIG. 3C shows another embodiment of a linear support segment.
FIG. 3D shows an embodiment of a tee extension.
FIG. 3E shows an embodiment of a coupler into which the linear support elements are joined.

Now referring primarily to FIG. 3, an alternate embodiment of the inventive pitching screen as shown by FIG. 3A provides a first linear support element (25) and a second linear support element (26) which can be disposed a distance apart in bilateral symmetry to protect the pitcher (1) after a pitch. The first linear support (25) and the second linear support (26) can be configured to provide a structural support which corresponds to the physical stature of the pitcher being protected. For example, the first linear support element (25) and the second linear support element (26) can have a length of between about 48 inches and about 120 inches. Similar to the arcuate supports above-described the linear support elements (25)(26) can be generated from the same kinds, types, and configurations of materials.

As shown further shown by FIG. 3A, each of the first linear support element (25) and the second linear support element (26) can be generated from a plurality of linear support segments (27), such as those shown by FIGS. 3B, 3G. and 3D which can be slidably engaged to couple as shown by FIG. 3F. A variety of alternate coupling configurations can used to generate the first linear support element (25) and the second linear support element (26) from the plurality of linear support segments (27), such as mated spiral threads, joints rotatable about the axis of a shaft, ball joints, or the like. A preferred embodiment of the inventive pitching screen which has axially coupled linear support segments (27) can further include a plurality of elastically tensioned couplings (28)(alternate embodiments of the inventive pitching screen as above-described or otherwise can also include elastically tensioned couplings). The elastically tensioned couplings can be generated by providing a resiliently elastic cord (40) located in the hollow space (41) of the tubular linear support segments (27). The resiliently elastic cord (40) can be sufficiently tensioned to assist in establishing and maintaining the linear support segments (27) in the assembled configuration. Alternately, resiliently elastic bands, resiliently elastic cord, resilient elastic tubular sleeves, or the like could be engaged with the exterior surface of the linear support segments (27) to provide a similar elastically tensioned coupler (28).

The pitching screen embodiment as shown by FIG. 3A can further provide the coupler (10) above-described to which the first end of the first linear support element (25) and the first end of the second linear support element (26) can slidely engage. The coupler (10) can be configured to establish the first linear support element (25) and the second linear support element (26) at an angle between about eighty degrees and about one hundred degrees, or can establish the first linear support element (25) and the second linear support element (26) at an angle of not more than 100 degrees. Alternately, the legs (15)(16) of the coupler (10) can independently rotate about the axis of a shaft to provide a variably adjustable angle between the first linear support segment (25) and the second linear support segment (27). Other embodiments of the inventive pitching screen, can provide a coupler (10) having a rectangular configuration to extend the screen vertically similar to that shown by FIG. 4A (arcuate support elements (5)(6) replaced with linear support elements (25)(26)).

Again referring to FIG. 3A, the inventive pitching screen can further include a base as described above having a tee (19)(20), or alternative configurations, coupled to the second end of each of the first linear support element (25) and the second linear support (26) to establish the linear support structure in a substantially fixed orientation to the support surface (7).

Again referring primarily to FIGS. 2B, 3A and 3H, as to certain embodiments of the inventive pitching screen, the first linear support element (25) and the second linear support element (26), or arcuate support elements (5)(6), can be made responsive to the corresponding ends of a restraint element (30) which can assist in maintaining the desired distance or angle between the first linear support element (25) and the second linear support element (26). As to certain embodiments of the inventive pitching screen, the restraint element (30) can be bifurcated at the ends to provide fixed or removable securement to a corresponding pair of legs (21)(22) and (23)(24) coupled to the first tee element (19) and the second tee element (20) respectively, as shown by FIG. 2B. As to certain embodiments of the inventive pitching screen, removable securement can be provided by hooks (31) which can be mated with a corresponding each of a circumferential groove (32). The restraint elements (30) illustrated by FIGS. 2B and 3H are not intended to be limiting with respect to the numerous and varied embodiments of the restraint element (30) which can be used in accordance with the invention which include, but are not limited to, a single cord established between the first linear support (25) and the second linear support (26); or a single resiliently elastic cord having variable adjustable length; or a resiliently elastic cord having one or more bifurcated ends.

As to certain preferred embodiments of the inventive pitching screen, the first end of the first linear support (25) (whether a single piece or a plurality of coupled linear segments) and the first end of the second linear support (26) (whether a single piece or coupled linear segments) can be joined to the coupler (10) having a fixed angle. The second end of the first linear support element (25) and the second end of the second linear support element (26) can be made responsive to the restraint element (30). The configuration of the restraint element (30) can be selected to generate flexure in the first linear support element (25) or flexure in the second linear support element (26), or both, as an alternate method of establishing a first arcuate support element (5) and a second arcuate support element (6). Alternate embodiments of the first linear support element (25) and the second linear support element (26)(depending on the material utilized) can provide greater or lesser flexure in response to restraint element (30). As such, certain embodiments of the linear support elements (25)(26) can provide sufficient flexure to provide a first arcuate support element (5) and a second arcuate support element (6) in which the flexure or curvature can be altered to correspond to, more closely correspond to, or match to the arcuate profile (9) of a pitcher (1) positioned after throwing a pitch. For example, flexure of the first linear support element (25) or the second linear support element (26) can define a radius of a circle of between about 36 inches and about 120 inches.

Now referring primarily to FIG. 4, a generic inventive pitching screen provides numerous and varied embodiments each establishing a first pitching lane (33) for a right-handed pitcher and a second pitching lane (34) for a left-handed pitcher in a single pitching screen. By providing a first pitching lane (33) and a second pitching lane (34) in the same pitching screen, the pitching screen does not have to be re-positioned between serial use by a left-handed pitcher and a right handed pitcher, or vice-versa. A particular embodiment of the generic inventive pitching screen as shown by FIG. 4B provides a first square or rectangular cutout (35) on the right side and a second square or rectangular cutout (36) on the left side of the same pitching screen which provide a first pitching lane and a second pitching lane (produced by configuring the pitching screen with a cutout area or relief in the pitching screen in which the path of a pitched ball can pass on its way to the pitching target, such as the strike zone of a batter or the target of a catching screen). Another particular embodiment of the generic inventive pitching screen shown by FIG. 4A provides a first partial arcuate cutout (37) and a second partial arcuate cutout (38) in the same pitching screen to provide a first pitching lane (33) and a second pitching lane (34). Another embodiment of the generic inventive pitching screen as shown by FIG. 4A provides an first angled cutout and a second angled cutout in the same pitching screen to provide a first pitching lane and a second pitching lane. Embodiments of the inventive pitching screen as shown by 4A and 4B can further include a coupler (10) joined to the linear or arcuate supports (5)(6) which provides a screen extension element (52). A preferred embodiment of the generic inventive pitching screen as shown by FIG. 2A provides a first arcuate cutout (39) and a second arcuate cutout (40) to provide a first pitching lane and a second pitching lane. These various examples of embodiments of the generic inventive pitching screen which provide a first cutout and a second cutout in the same pitching screen are not intended to be limiting with respect to the various embodiments of pitching screens which are encompassed by the generic inventive pitching screen, but rather are intended to be illustrative of the numerous and varied configurations of pitching screens which can be made and used in accordance with the invention.

Now referring primarily to FIG. 5, certain embodiments of the inventive pitching screen can be provided as a kit which includes a folded configuration (39) of a plurality of linear segments (27) which can have elastically tensioned couplers (28)(or without elastically tensioned couplers), as shown by FIG. 5A. The plurality of linear segments (27) can be of tubular configuration as shown in FIG. 5A each having a length of between about 24 inches and about 36 inches and having an outside diameter of between about one inch and one and one-half inches with a wall thickness of between about three thirty seconds of an inch to about three sixteenths of an inch.

The embodiment of the kit shown by FIG. 5, provide a folded configuration of the plurality of linear segments (27) of the first linear support element (25) and the second linear support element (26) which are slidably inserted into the coupler (10) without removing the elastic cord (40) which can run within the hollow (41) of the tubular linear segments (27) to generate the elastically tensioned coupler (28). The folded configuration (39) of the linear support elements (25)(26) can then be located, stored, or transported in a case (42) (such as the case shown by FIG. 5D which can be between about 30 inches and about 40 inches in length and can have a diameter of between about 10 inches and about 20 inches. The case (42) can be made of a substantially rigid construction or a flexible construction with a non-limiting preferred embodiment of the inventive pitching screen made from a flexible woven material with a zipper or mated hook and loop closure (43)(such as VELCRO®), as shown.

The kit to generate a pitching screen in accordance with the invention can further include an amount of object deflection material (8)(FIG. 5C) configured to conform to the configuration of the particular embodiment of the pitching screen invention when assembled. The object deflection (8) material as shown can be a net which can be folded for storage in the case (42).

The kit can further include a base as shown by FIG. 5B. The base can comprise a pair of single piece tees (17) and (18) each attached to the bifurcated end of the restraint element (30).

Again referring primarily to FIG. 4B, the inventive pitching screen described above can further include a pitching target or a batting target (51) so that the pitching screen can also be used as a catch screen to stop pitched or batted balls. The pitching target or batting target can provide a sensorial perceivable indicia, such as color, reflective material, fluorescent material, or the like, which indicates the target area (44). The pitching target or batting target (51) can further provide a target pouch (45) in which balls are collected.

Now referring primarily to FIG. 4A, the pitching screen invention described above can further include a left hand net cutout (48) or a right hand net cutout (49), or both, so that the pitching screen invention can be utilized for underhand pitching.

As can be easily understood from the foregoing, the basic concepts of the present invention may be embodied in a variety of ways. The invention involves numerous and varied embodiments of a generic pitching screen which provides a first pitching lane and a second pitching lane in a single pitching screen and methods of making and using such pitching screen and a pitching screen which has a support structure which includes linear or arcuate elements which protect the arcuate profile of a pitcher in the position after the pitch is thrown.

As such, the particular embodiments or elements of the invention disclosed by the description or shown in the figures accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "pitch" should be understood to encompass disclosure of the act of "pitching"—whether explicitly discussed or not—and, conversely, were there effectively disclosure of the act of "pitching", such a disclosure should be understood to encompass disclosure of a "pitch" and even a "means for pitching." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

Thus, the applicant(s) should be understood to claim at least: i) each of the pitching screens herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The claims set forth in this application are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth below are intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A pitching screen, comprising:

a. a support structure providing;

i. a first linear support element having a length of between about 48 inches and about 120 inches disposed between a first end and a second end;

ii. a second linear support element having a length of between about 48 inches and about 120 inches disposed between a first end and a second end; and iii. a coupler to which said first end of said first linear support element and said first end of said second linear support element couple to establish said first end of said linear support element and said first end of said second linear support at a fixed angle of not more than about 100 degrees;

iv. a base coupled to said second end of said first linear support and coupled to said second end of said second linear support to locate said second end of said first linear support element and said second end of said second linear support element a distance apart proximate to a support surface and locates said first end of said first linear support coupled to said first end of said second linear support distal from said support surface;

v. a restraint element which extends between said second end of said first linear support element and said second end of said second linear support element, and wherein said restraint element generates flexure in said first linear support element to establish a first arcuate support element, and wherein said restraint element generates flexure in said second linear support element to establish a second arcuate support element; and b. an object deflection material having a plurality of aperture elements establishes a substantially planar screen bounded by said support structure.

2. A pitching screen as described in claim 1, wherein flexure of said first linear support element and flexure of said second linear support element each define a radius of a circle of between about 36 inches and about 120 inches.

3. A pitching screen as described in claim 2, wherein said first linear support element comprises a plurality of axially coupled linear support segments.

4. A pitching screen as described in claim 3, wherein said second linear support element comprises a plurality of axially coupled linear support segments.

5. A pitching screen as described in claim 4, further comprising an elastically tensioned coupling between said plurality of axially coupled linear support segments.

6. A pitching screen as described in claim 5, wherein said coupler of said support structure is established at a distance above said support surface of between about 60 inches and about 120 inches.

7. A pitching screen as described in claim 6, wherein said base comprises:

a. a first tee extension coupled to said second end of said first linear support element; and b. a second tee extension coupled to said second end of said second linear support element.

8. A pitching screen as described in claim 7, wherein said restraint element comprises a bifurcated restraint element each end having a pair of connectors which couple with each leg of said first tee element and said second tee element.

9. A pitching screen as described in claim 8, wherein said object deflection material having a plurality of aperture elements is selected from the group consisting of a woven material, a knotted material, a net material, and a screen material.

10. A pitching screen as described in claim 9, wherein said object deflection material deflects an object selected from the group consisting of a ball, a soft ball, a baseball, a soccer ball, a tennis ball, and a foot ball.

* * * * *